United States Patent [19]

Eylon et al.

[11] Patent Number: 4,714,587

[45] Date of Patent: Dec. 22, 1987

[54] METHOD FOR PRODUCING VERY FINE MICROSTRUCTURES IN TITANIUM ALLOY POWDER COMPACTS

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 13,818

[22] Filed: Feb. 11, 1987

[51] Int. Cl.[4] ..... C21D 1/00

[52] U.S. Cl. ..... 419/29; 419/25; 419/30; 419/39; 419/42; 419/49; 419/53; 419/54; 419/55; 75/245; 148/11.5 F; 148/133

[58] Field of Search ..... 419/25, 55, 49, 54, 419/29, 53, 42, 39, 30; 148/11.5 F, 133; 75/245

[56] References Cited

U.S. PATENT DOCUMENTS

| | | | |
|---|---|---|---|
| 3,729,971 | 5/1973 | Gurganus et al. | 419/49 |
| 4,110,131 | 8/1978 | Gessinger | 148/11.5 N |
| 4,250,610 | 2/1981 | Wilbers et al. | 29/424 |
| 4,381,942 | 5/1983 | Blum et al. | 419/23 |
| 4,482,398 | 11/1984 | Eylon et al. | 148/11.5 F |
| 4,601,874 | 7/1986 | Marty et al. | 419/26 |

OTHER PUBLICATIONS

D. Eylon and F. H. Froes, "HIP Compaction of Titanium Alloy Powders at High Pressure and Low Temperature (HPLT), reprinted from Metal Powder Report, vol. 41, No. 4, Apr. 1986.

*Primary Examiner*—Stephen J. Lechert, Jr.

*Attorney, Agent, or Firm*—Charles E. Bricker; Donald J. Singer

[57] ABSTRACT

A process for producing titanium alloy articles by Hot Isostatic Pressing of a rapidly-solidified titanium alloy powder is provided wherein such pressing is carried out at a pressure greater than 30 ksi, and a temperature of about 60 to 80 percent of the beta-transus temperature of the alloy, in degrees C. Hot Isostatic Pressing under these conditions allows retention of the fine microstructure of the rapidly-solidified powder. The compacted article may be subjected to heat treatment to alter its microstructure.

18 Claims, 14 Drawing Figures

METHOD FOR PRODUCING VERY FINE MICROSTRUCTURES IN TITANIUM ALLOY POWDER COMPACTS

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of titanium alloy articles fabricated by powder metallurgy to improve the microstructure of such articles.

Titanium alloy parts are ideally suited for advanced aerospace systems because of their excellent general corrosion resistance and their unique high specific strength (strength-to-density ratio) at room temperature and at moderately elevated temperatures. Despite these attractive features, the use of titanium alloys in engines and airframes is often limited by cost due, at least in part, to the difficulty associated with forging and machining titanium.

To circumvent the high cost of titanium alloy parts, several methods of making parts to near-net shape have been developed to eliminate or minimize forging and/or machining. These methods include superplastic forming, isothermal forging, diffusion bonding, investment casting and powder metallurgy, each having advantages and disadvantages.

Until relatively recently, the primary motivation for using the powder metallurgy approach for titanium was to reduce cost. In general terms, powder metallurgy involves powder production followed by compaction of the powder to produce a solid article. The small, homogeneous powder particles provide a uniformly fine microstructure in the final product. If the final article is made net-shape by the application of Hot Isostatic Pressing (HIP), a lack of texture can result, thus giving equal properties in all directions. The HIP process has been practiced within a relatively broad temperature range, for example, about 700° to 1200° C. (1300°-2200° F.), depending upon the alloy being treated, and within a relatively broad pressure range, for example, 1 to 30 ksi, generally about 15 ksi.

In U.S. Pat. Nos. 4,534,808 and 4,536,234 we disclose methods for refining the microstructures of as-produced net-shape titanium articles made by powder metallurgy for the purpose of improving mechanical properties, such as tensile and fatigue strengths. Briefly, these methods comprise beta-solution heat treating the article, rapidly cooling the article, and annealing the article at a temperature below the beta-transus temperature. We have now discovered a method for producing articles by powder metallurgy which affords closer control of the microstructure of the final article.

Accordingly, it is an object of the present invention to provide a process for producing articles having a desired microstructure by powder metallurgy of titanium alloys.

Other objects, aspects and advantages of the present invention will be apparent to those skilled in the art after reading the detailed description of the invention as well as the appended claims.

SUMMARY OF THE INVENTION

In accordance with the present invention there is provided a process for producing titanium alloy articles having a desired microstructure which comprises the steps of:

(a) providing prealloyed titanium alloy powder;
(b) filling a suitable die or mold with the powder;
(c) hot isostatic press (HIP) consolidating the powder in the filled mold at a pressure of 30 Ksi or greater and at a temperature of about 60 to 80 percent of the beta transus temperature of the alloy, in degrees C.

Optionally, following the hot isostatic pressing step, the article may be heat treated to alter its microstructure.

DETAILED DESCRIPTION OF THE INVENTION

Figure 1:
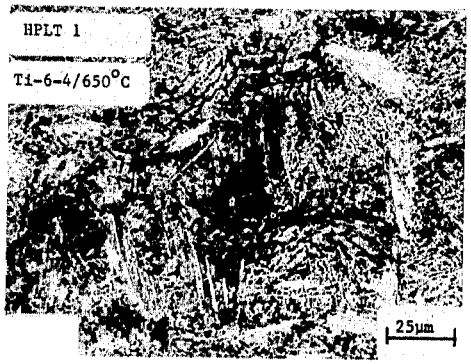
FIGS. 1-4 are 600× photomicrographs illustrating the fine microstructures of Ti-6Al-4V and Ti-10V-2Fe-3Al alloys compacted according to the invention.
Figure 2:
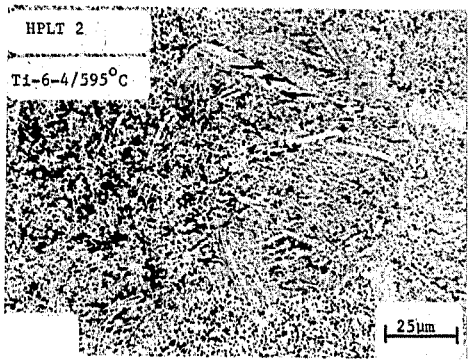

The alloy to be used in this invention can be any titanium alloy. Typical alloys include the following:

Alpha and Near-Alpha Alloys:
- Ti-0.8Ni-0.8Mo
- Ti-5Al-2.5Sn
- Ti-8Al-1Mo-1V
- Ti-6Al-2Sn-4Zr-2Mo-0.1Si
- Ti-6Al-2Nb-1Ta-0.8Mo
- Ti-2.25Al-11Sn-5Zr-1Mo Alpha-Beta Alloys:
- Ti-6Al-4b
- Ti-6Al-6V-2Sn
- Ti-8Mn
- Ti-7Al-4Mo
- Ti-4.5Al-5Mo-1.5Cr
- Ti-6Al-2Sn-4Zr-6Mo
- Ti-5Al-2Sn-2Zr-4Mo-4Cr
- Ti-6Al-2Sn-2Zr-2Mo-2Cr
- Ti-3Al-2.5V Beta Alloys:
- Ti-13V-11Cr-3Al
- Ti-8Mo-8V-2Fe-3Al
- Ti-3Al-8V-6Cr-4Mo-4Zr
- Ti-10V-2Fe-3Al
- Ti-11.5Mo-6Zr-4.5Sn
- Ti-15V-3Cr-3Al-3Sn The alloy may further contain up to about 6 w/percent of a dispersoid such as boron, thorium or a rare earth element.

For production of high quality, near-net titanium shapes according to the invention, spherical powder free of detrimental foreign particles is desired. In contrast to flake or angular particles, spherical powder flows readily, with minimal bridging tendency, and packs to a consistent density (about 65%).

A variety of techniques may be employed to make the titanium alloy powder, including the rotating electrode process (REP) and variants thereof such as melting by plasma arc (PREP) or laser (LREP) or electron beam, electron beam rotating disc (EBID), powder under vacuum (PSV), and the like. These techniques typically exhibit cooling rates of about 100° to 100,000° C./sec. The powder typically has a diameter of about 25 to 600 microns. Optionally, prior to use in the present invention, the titanium alloy powder can be worked to promote better metallurgical bonding. The strain energizing process (SEP), which involves working the powder particles by deforming them in a rolling mill, increases the aspect ratio of the powder. Additionally, this process permits the alpha morphology of the powder to be modified for fatigue strength enhancement.

Production of shapes may be accomplished using a metal can, ceramic mold or fluid die technique. In the metal can technique, a metal can is shaped to the desired configuration by state-of-the-art sheet-metal methods, e.g. brake bending, press forming, spinning, superplastic forming, etc. The most satisfactory container appears to be carbon steel, which reacts minimally with the titanium, forming titanium carbide which then inhibits further reactions. Fairly complex shapes have been produced by this technique.

The ceramic mold process relies basically on the technology developed by the investment casting industry, in that molds are prepared by the lost-wax process. In this process, wax patterns are prepared as shapes intentionally larger than the final configuration. This is necessary since in powder metallurgy a large volume difference occurs in going from the wax pattern (which subsequently becomes the mold) and the consolidated compact. Knowing the configuration aimed for in the compacted shape, allowances can be made using the packing density of the powder to define the required wax-pattern shape.

The fluid die or rapid omnidirectional consolidation (ROC) process is an outgrowth of work on glass containers. In the current process, dies are machined or cast from a range of carbon steels or made from ceramic materials. The dies are of sufficient mass and dimensions to behave as a viscous liquid under pressure at temperature when contained in an outer, more rigid pot die, if necessary. The fluid dies are typically made in two halves, with inserts where necessary to simplify manufacture. The two halves are then joined together to form a hermetic seal. Powder loading, evacuation and consolidation then follow. The fluid die process is claimed to combine the ruggedness and fabricability of metal with the flow characteristics of glass to generate a replicating container capable of producing extremely complex shapes.

In the metal can and ceramic mold processes, the powder-filled mold is supported in a secondary pressing medium contained in a collapsible vessel, e.g., a welded metal can. Following evacuation and elevated-temperature outgassing, the vessel is sealed, then placed in an autoclave or other apparatus capable of isostatically compressing the vessel.

Consolidation of the titanium alloy powder is accomplished by applying a pressure of at least 30 ksi, preferably at least about 35 ksi, at a temperature of about 60 to 80 percent of the beta transus temperature of the alloy (in degrees C.) for about 4 to 48 hours. It will be recognized by those skilled in the art that the practical maximum applied pressure is limited by the apparatus employed.

Following consolidation, the compacted article is recovered, using techniques known in the art. The resulting article is fully dense and has a very fine microstructure. The microstructure of the compacted article can be subsequently altered by annealing, beta-solution heat treatment or a combination thereof.

Annealing is typically carried out at a temperature about 15 to 30% below the beta-transus temperature (in °C.) of the alloy for about 2 to 36 hours in a vacuum or inert atmosphere to protect the surface of the article from oxidation, followed by air or furnace cooling to room temperature. For example, annealing of Ti-6Al-4V alloy, which has a beta-transus of about 1000° C., is typically carried out between 700° and 850° C.

Beta-solution heat treatment may be carried out by heating the article to approximately the beta-transus temperature of the alloy, i.e., about 5% below to about 10% above the beta-transus temperature (in °C., for about 10 to 240 minutes, followed by rapid cooling. Cooling may be accomplished by quenching the article in a suitable liquid quenching medium, such as water or oil.

The following example illustrates the invention.

EXAMPLE

−35 mesh Ti-6Al-4V (Ti-6-4) and Ti-10V-2Fe-3Al (Ti-10-2-3) powders prepared by the rotating electrode process (REP) and the plasma rotating electrode process (PREP), respectively, were employed. One-half of each batch of powder was used in the as-produced condition and one-half was subjected to the strain energing process (SEP), using a double pass reduction (60%).

Compaction of the above powders was performed in a 45 ksi (315 MPa) autoclave with a workspace of 140 mm (5.6 inch) diameter×280 mm (11.2 inch) length. The powders were filled into welded mold steel cans. The final compact dimension after removal of the can was 50 mm (2.0 inch) diameter×180 mm (3.2 inch) long. The consolidation conditions are given in Table I, following.

TABLE I

| | | Compaction Conditions | | Consolidation | |
|---|---|---|---|---|---|
| Desig. | Alloy | Powder Treat. | Temp °C. | Press. ksi | Time, hr. |
| HPLT1 | Ti-6-4 | — | 650 | 45 | 24 |
| HPLT2 | Ti-6-4 | SEP | 595 | 45 | 24 |
| HPLT3 | Ti-10-2-3 | — | 595 | 45 | 24 |
| HPLT4 | Ti-10-2-3 | SEP | 540 | 45 | 24 |

Specimens of each of the compacts were heat treated in accordance with the schedule shown in Table II. Room temperature tensile tests were performed on the as-compacted specimens and the heat-treated specimens. Due to the small dimensions of the material available, tensile tests were conducted on subsize smooth bar specimens 2.5 mm (0.1 inch) gage diameter×17.5 mm (0.7 inch) gage length. Tensile test strain rate was maintained at 0.005 mm/mm/min through the 0.2% yield point followed by 1.25 mm/min cross head speed to failure.

TABLE II

| Desig. | Heat Treatment, °C./hr/m* | Tensile Results % YS (ksi) | UTS (ksi) | EL (%) | RA (%) |
|---|---|---|---|---|---|
| HPLT1 | None | 157 | 164 | 8 | 19 |
| | 815/24/AC | 136 | 147 | 22 | 38 |
| HPLT2 | None | — | 149 | 0.2 | 0 |
| | 705/2/FC | — | 150 | 0 | 1 |
| | 705/24/FC | 153 | 155 | 1 | 5 |
| | 815/2/FC | 160 | 163 | 1 | 4 |
| | 815/24/FC | 144 | 160 | 7 | 17 |
| | 955/2/FC | 140 | 149 | 8 | 26 |
| HPLT3 | None | 138 | 144 | 14 | 49 |
| | 760/1/WQ + 510/8/AC | 178 | 188 | 3 | 6 |
| | 760/3/AC + 370/4/AC | — | 210 | 1 | 4 |
| | 790/3/AC + 370/4/AC | 212 | 227 | 1 | 1 |
| HPLT4 | None | 145 | 146 | 1 | 3 |
| | 750/1/WQ + 550/8/AC | 166 | 169 | 1 | 2 |
| | 760/1/WQ + 510/8/AC | — | 159 | 0 | 0 |

*m = cooling technique:
AC = air cool
FC = furnace cool
WQ = water quench

Examination of the above data indicates that the Ti-6-4 compacted at 595° C. (HPLT2) and the Ti-10-2-3 compacted at 540° C. (HPLT4) displayed almost no elongation in the as-compacted/non-heat-treated condition. Microscopic examination of these specimens revealed particle debonding, including flat debonded particle boundaries, believed to result from SEP'ing the powders. In contrast, the specimens compacted at higher temperatures (Ti-6-4 at 650° C. (HPLT1) and Ti-10-2-3 at 595° C. (HPLT3)) displayed adequate elongation.

The as-compacted microstructure of HPLT1 through HPLT4 are shown in FIGS. 1–4, respectively. The microstructures of all four compacts are very fine due to the low compaction temperatures which did not allow much coarsening of the fine powder particle microstructure. The microstructure of HPLT1 and HPLT2 (FIGS. 1 and 2) consist of a very fine alpha phase. Part of the fine alpha phase has a lenticular morphology, similar to the microstructure of the as-produced powder particles, and part is equiaxed (1–2 microns) in a matrix of beta.

Figure 3:
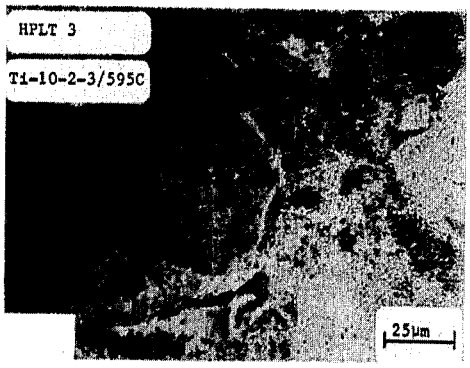
Figure 4:
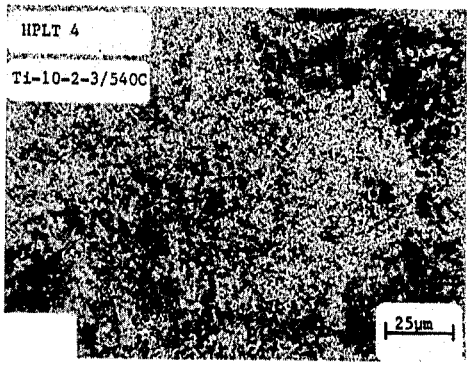
Figure 5:
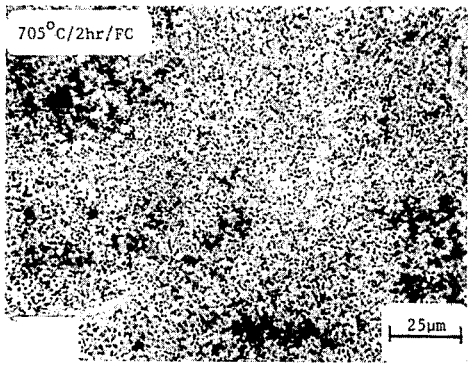
FIGS. 5-10 are 600× photomicrographs of Ti-6Al-4V powder compacts prepared according to the invention, then heat treated according to the invention, then heat treated under various conditions.
Figure 6:
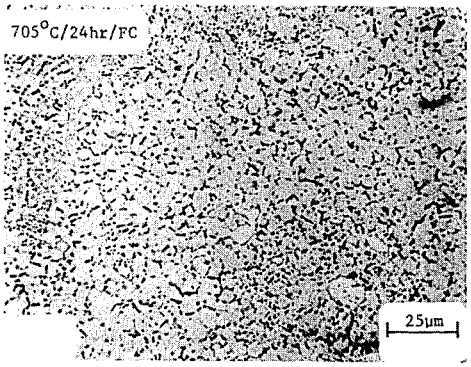
Figure 7:
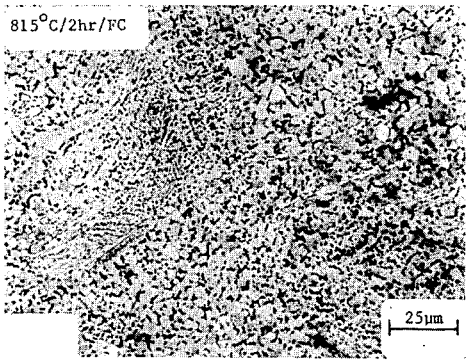
Figure 8:
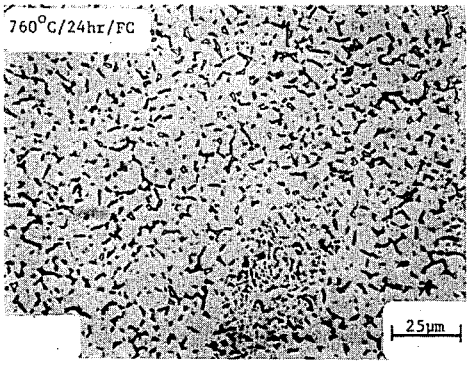
Figure 9:
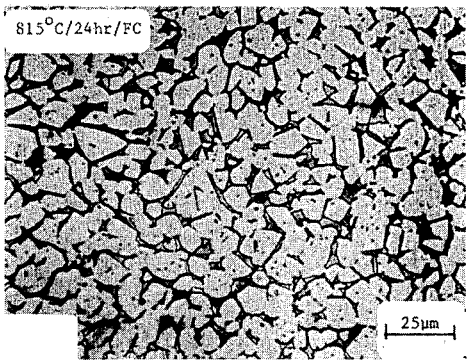
Figure 10:
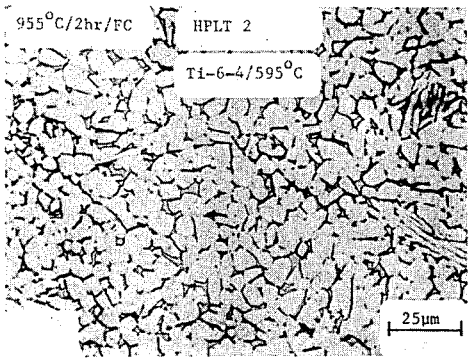
Figure 11:
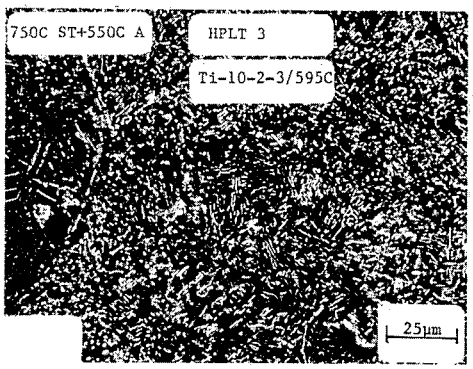
FIGS. 11-14 are 600× photomicrographs of Ti-10V-2Fe-3Al powder compacts prepared according to the invention, then heat treated under various conditions.
Figure 12:
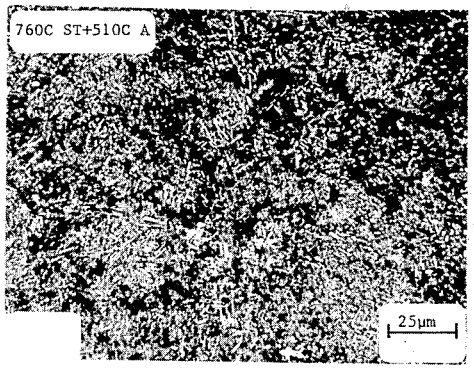

The as-produced Ti-10-2-3 powder particles have a columnar beta structure at the particle surface, the result of a high cooling rate. This microstructure degenerates into a beta dendritic structure, the result of slower cooling rates inside the particle. Referring to FIGS. 3 and 4, in the as-compacted Ti-10-2-3 (HPLT3 and HPLT4, respectively), micron size alpha precipitation is visible. In some regions, such as in the upper part of FIG. 3, traces of the columnar structure are still visible.

The results of recrystallization of the HPLT2 and HPLT4 compacts are shown in FIGS. 5–10 and FIGS. 11–14, respectively. The recrystallization conditions are given in Table III.

TABLE III

| FIGS. | Desig | Recrystallization Condition °C./hr/cooling method |
|---|---|---|
| 5 | HPLT2 | 705/2/FC |
| 6 | HPLT2 | 705/24/FC |
| 7 | HPLT2 | 815/2/FC |

TABLE III-continued

| FIGS. | Desig | Recrystallization Condition °C./hr/cooling method |
|---|---|---|
| 8 | HPLT2 | 760/24/FC |
| 9 | HPLT2 | 815/24/FC |
| 10 | HPLT2 | 955/2/FC |
| 11 | HPLT4 | 750/1/WQ + 550/8/AC |
| 12 | HPLT4 | 760/1/WQ + 510/8/AC |
| 13 | HPLT4 | 760/3/AC + 370/4/AC |
| 14 | HPLT4 | 790/3/AC + 370/4/AC |

The amount of recrystallization is shown in FIGS. 5–10 in increasing order. Full recrystallization is achieved both at 955/2 and 815/24. Examination of Table II reveals that only under these two conditions was tensile elongation of the compact restored.

Figure 13:
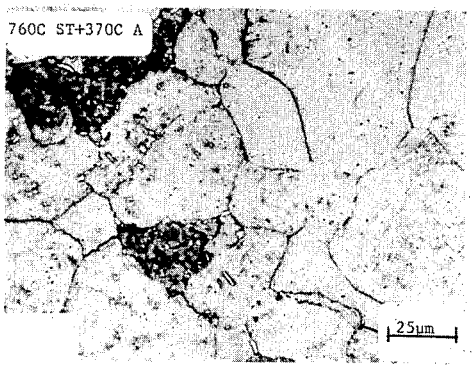
Figure 14:
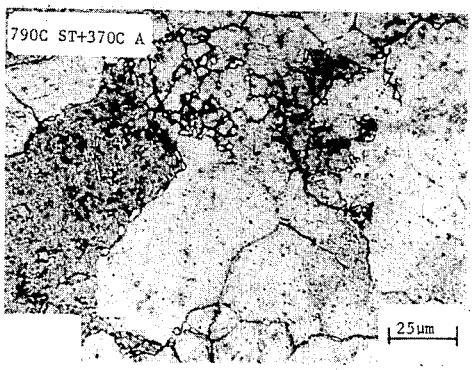

With reference to FIGS. 11–14, the beta solution heat treatments followed by 370° C. aging generally resulted in microstructures with almost no alpha precipitates, or with precipitates too small to be resolved at an optical level (FIGS. 13, 14). However, solution treatment followed by 550° C. and 510° C. again (FIGS. 11 and 12) resulted in microstructures with micron size globular and elongated alpha precipitates. Examination of Table II reveals that these heat treatments resulted in a substantial increase in strength (From 144 to 227 ksi) with a loss of tensile elongation (from 14% to 1%).

Various modifications may be made in the present invention without departing from the spirit of the invention or the scope of the appended claims.

We claim:

1. A process for producing titanium alloy articles having a desired microstructure which comprises the steps of:

(a) providing a prealloyed titanium powder;

(b) filling a suitable mold with said powder; and (c) consolidating the powder in the filled mold at a pressure of at least 30 ksi and a temperature about 60 to 80 percent of the beta transus temperature of said alloy, in degrees-C., for about 4 to 48 hours.

2. The process of claim 1 further comprising the step of:

(d) annealing the resulting consolidated article to alter its microstructure.

3. The process of claim 1 wherein said providing step (a) comprises subjecting said powder to a strain energing process prior to said step (b).

4. The process of claim 1 wherein said pressure is at least 35 ksi.

5. The process of claim 1 further comprising the step of:

(d) beta-solution heat treating the resulting consolidated article to alter its microstructure.

6. The process of claim 1 further comprising the steps of:

(d) beta-solution heat treating the resulting consolidated article; and (e) annealing the heat treated, consolidated article.

7. The process of claim 1 wherein said alloy is Ti-6Al-4V, and wherein said consolidation is carried out at 650° C. at 45 ksi for 24 hours.

8. The process of claim 7 further comprising the step of annealing the thus-consolidated article at 815° C. for 24 hours followed by air cooling to room temperature.

9. The process of claim 3 wherein said alloy is Ti-6Al-4V, and wherein consolidation is carried about at 595° C. at 45 ksi for 24 hours.

10. The process of claim 9 further comprising the step of annealing the thus-consolidated article at 705° C. for 24 hours followed by furnace cooling to room temperature.

11. The process of claim 9 further comprising the step of annealing the thus-compacted article at 815° C. for 24 hours followed by furnace cooling to room temperature.

12. The process of claim 9 further comprising the step of annealing the thus-consolidated article at 815° C. for 24 hours followed by furnace cooling.

13. The process of claim 9 further comprising the step of heating the thus-consolidated article at 955° C. for 2 hours followed by furnace cooling.

14. The process of claim 1 wherein said alloy is Ti-10V-2Fe-3Al and wherein consolidation is carried out at 505° C. for 24 hours.

15. The process of claim 14 further comprising the steps of heat treating the thus-consolidated article at 760° C. for one hour followed by water quench, and heating the thus-heat-treated article at 510° C. for 8 hours followed by air cooling.

16. The process of claim 14 further comprising th steps of heat-treating the thus-consolidated article at 790° C. for 3 hours followed by air cooling, and heating the thus-heat-treated article at 370° C. for 4 hours followed by air cooling.

17. The process of claim 3 wherein said alloy is Ti-10V-2Fe-3Al and wherein consolidation is carried out at 540° C. at 45 ksi for 24 hours.

18. The process of claim 17 further comprising the steps of heat treating the thus-consolidated article at 750° C. for one hour followed by water quench, and heating the thus-heat-treated article at 550° C. for 8 hours followed by air cooling.

* * * * *